US012421702B1

(12) United States Patent
Yan

(10) Patent No.: US 12,421,702 B1
(45) Date of Patent: Sep. 23, 2025

(54) MULTI-FUNCTIONAL SHOWER-HEAD SUPPORT ARM

(71) Applicant: XIAMEN GALENPOO KITCHEN & BATHROOM TECHNOLOGY CO., LTD, Xiamen (CN)

(72) Inventor: Xiaoling Yan, Xiamen (CN)

(73) Assignee: XIAMEN GALENPOO KITCHEN & BATHROOM TECHNOLOGY CO., LTD, Xiamen (CN)

( * ) Notice: Subject to any disclaimer, the term of this patent is extended or adjusted under 35 U.S.C. 154(b) by 0 days.

(21) Appl. No.: 18/893,905

(22) Filed: Sep. 23, 2024

(30) Foreign Application Priority Data

Aug. 8, 2024 (CN) ..... 202421909055.X

(51) Int. Cl.
*E03C 1/06* (2006.01)

(52) U.S. Cl.
CPC ..... *E03C 1/066* (2013.01)

(58) Field of Classification Search
CPC ..... E03C 1/066
USPC ..... 4/615
See application file for complete search history.

(56) References Cited

U.S. PATENT DOCUMENTS

2023/0175240 A1* 6/2023 Yan ..... E03C 1/0408 239/281

* cited by examiner

*Primary Examiner* — Lauren A Crane
(74) *Attorney, Agent, or Firm* — FIDELI LAW PLLC; Qiang Li

(57) ABSTRACT

The present invention discloses a multi-functional shower-head support arm, resolving the problem of a single function of a top spray in the prior art. The shower-head support arm can be used as a top spray or a shower head hanger, allowing for adjustment of a shower head in position and direction. The multi-functional shower-head support arm includes a main support arm, an auxiliary support arm, and a shower head holder. The main support arm is provided with a water inlet on a back surface and a water outlet at an upper end, and the water outlet communicates with the water inlet. A first end of the auxiliary support arm is rotated to fit with a lower end of the main support arm. The shower head holder is rotated to fit with a second end of the auxiliary support arm and is configured to hold and fix the shower head.

8 Claims, 5 Drawing Sheets

MULTI-FUNCTIONAL SHOWER-HEAD SUPPORT ARM

BACKGROUND

1. Technical Field

The present invention relates to the technical field of bathroom products, specifically to a multi-functional shower-head support arm.

2. Background Information

The shower apparatus is common sanitary equipment in modern life, providing people a convenient and quick way to bathe. The shower apparatus is typically formed by components such as a top spray, a handheld shower head, and a spray gun, with a valve/switch controlling the flow and direction of water, achieving different functions.

In the prior art, the top spray of the shower apparatus is usually just a water outlet member mounted at the top of a shower rod, providing a vertical water flow from the top, so as to give the user a different shower experience. However, it cannot provide other functions and is relatively single-functional.

BRIEF SUMMARY

An objective of the present invention is to provide a multi-functional shower-head support arm to resolve the existing problems in the prior art. The shower-head support arm can be used as a top spray or a shower head hanger, allowing for adjustment of the shower head in position and direction.

To achieve the above objective, the present invention provides the following solution:

A multi-functional shower-head support arm is provided, including a main support arm, an auxiliary support arm, and a shower head holder. A back surface of the main support arm is provided with a water inlet, an upper end of a front surface thereof is provided with a water outlet, and the water outlet communicates with the water inlet. A first end of the auxiliary support arm is rotated to fit with a lower end of the front surface of the main support arm. The shower head holder is rotated to fit with a second end of the auxiliary support arm and is configured to hold and fix a shower head.

The multi-functional shower-head support arm further includes a water outlet pipe. A water inlet chamber is provided in the water inlet of the main support arm, the water outlet pipe is disposed in the main support arm, a water inlet end thereof communicates with the water inlet chamber, and a water outlet end of the water outlet pipe is fixed at the water outlet.

Preferably, an adapter is mounted in the water inlet chamber. The adapter is a hollow pipe fitting with an upper end provided with a water inlet hole, and a circumferential surface of the upper end is provided with a water flowing groove. The upper end of the adapter rotatably fits in the water inlet chamber. Water enters the adapter when the water inlet hole is opposite the water inlet, and the water flowing groove is used for communication between the water inlet and the water outlet pipe.

Preferably, a circumferential surface of the adapter is provided with a toggle.

The water inlet is mounted with a water inlet ball head.

The lower end of the front surface of the main support arm is provided with a rotating seat, and the first end of the auxiliary support arm and the rotating seat are arranged co-axially and fixed using a screw.

Preferably, a rubber gasket is provided between contact surfaces of the main support arm and the auxiliary support arm.

Preferably, the first end of the auxiliary support arm is provided with a perforation for the screw to penetrate, and the perforation is covered by a cover.

With the use of the above technical solution, the present invention has the following technical effects:

In the present invention, a main support arm is combined with an auxiliary support arm. The main support arm itself has a water inlet and a water outlet, and can be used as a top spray. The auxiliary support arm is mounted with a shower head holder for holding and fixing a shower head, and can be used as a shower head hanger. The combination between the auxiliary support arm and the main support arm, and between the shower head holder and the auxiliary support arm, is rotatable, allowing the position and direction of the shower head to be adjusted within a 360° range, thus meeting demands for different usage scenarios. Thanks to the direction adjustment of the auxiliary support arm and the shower head holder, the main support arm can be mounted on different types of shower rods with water coming out of the top or a side, without limitation. In summary, the product of the present invention has rich use and adjustment functions, can be folded for storage, and is applied to broad scenarios, meeting various user needs.

1. main support arm; 11. water inlet; 12. water outlet; 13. water inlet chamber; 2. auxiliary support arm; 21. perforation; 3. shower head holder; 4. water outlet pipe; 5. adapter; 51. water inlet hole; 52. water flowing groove; 53. toggle; 6. water inlet ball head; 7. rotating seat; 8. screw; 9. rubber gasket; and 10. cover.

DETAILED DESCRIPTION OF THE DRAWINGS AND THE PRESENTLY PREFERRED EMBODIMENTS

To further describe the technical solution of the present invention, the present invention is described below in detail with reference to the specific embodiments.

Figure 1:
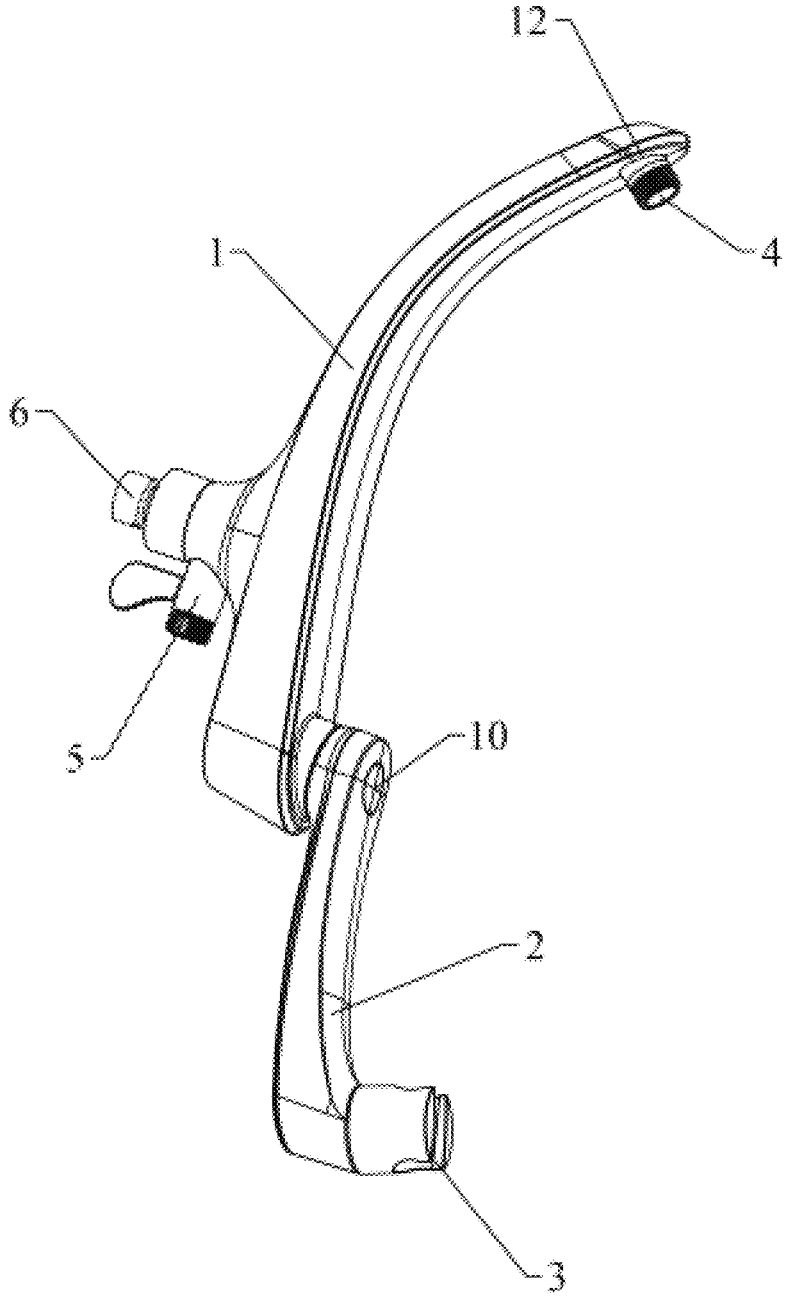
FIG. 1 is a three-dimensional view according to a specific embodiment of the present invention.
Figure 2:
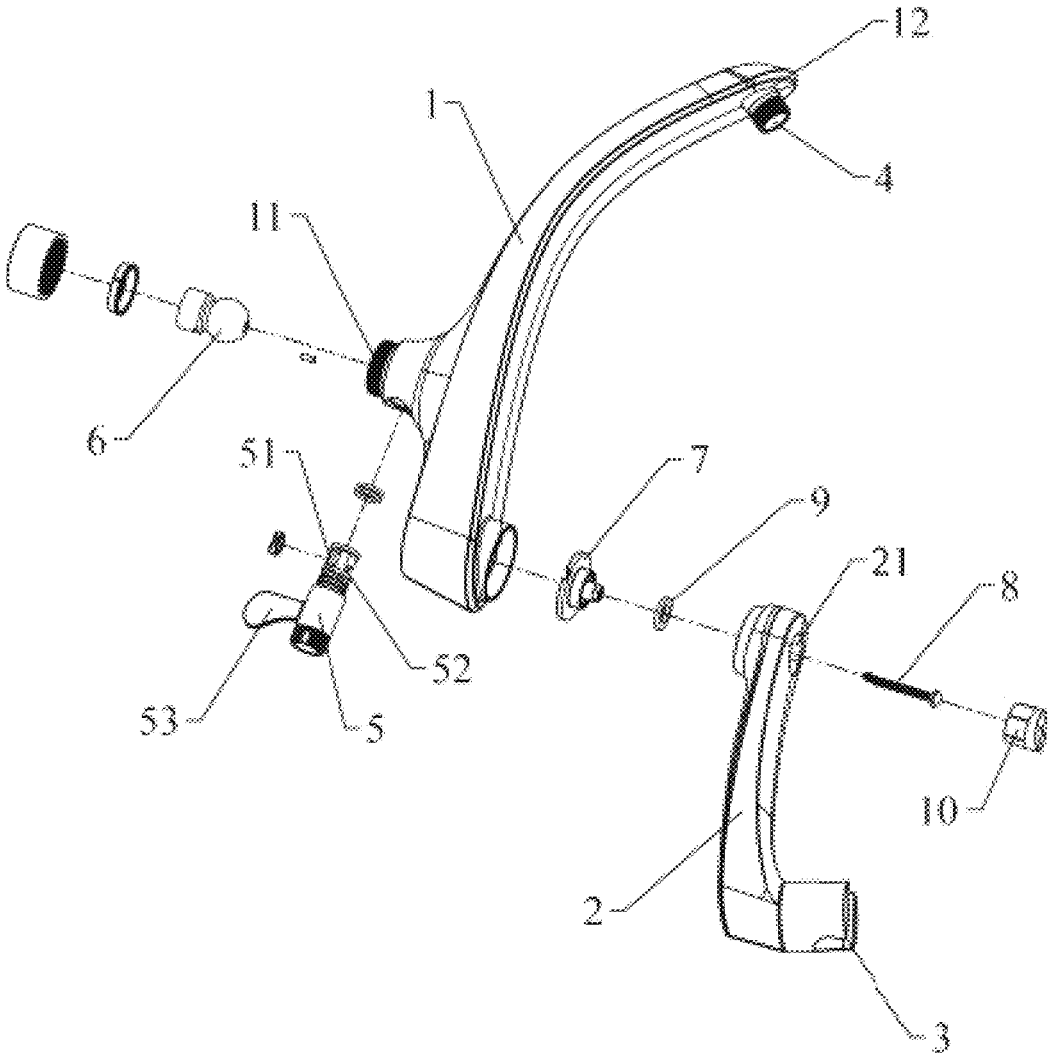
FIG. 2 is an exploded view according to a specific embodiment of the present invention.
Figure 3:
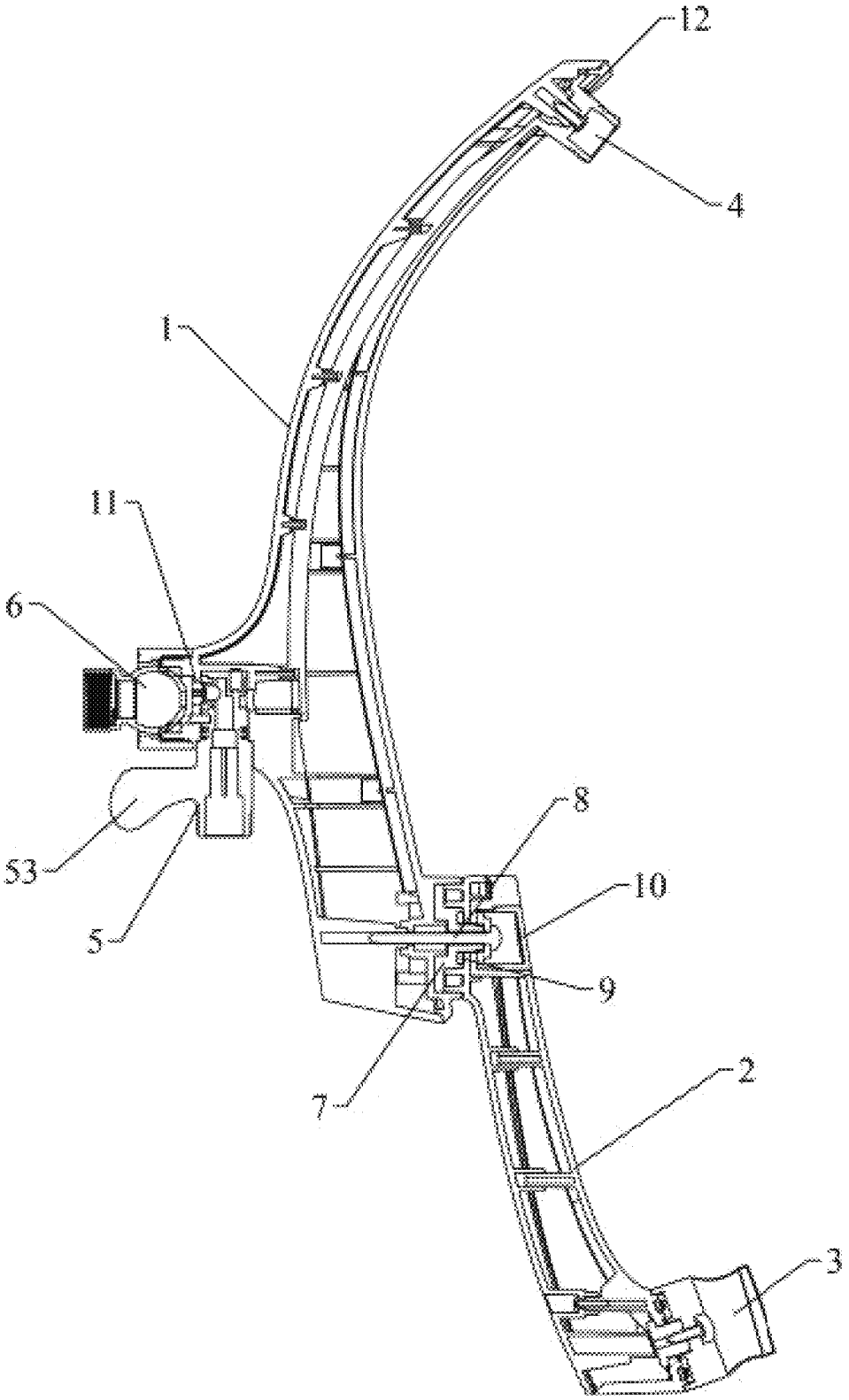
FIG. 3 is a cross-sectional view of a combination state according to a specific embodiment of the present invention.
Figure 4:
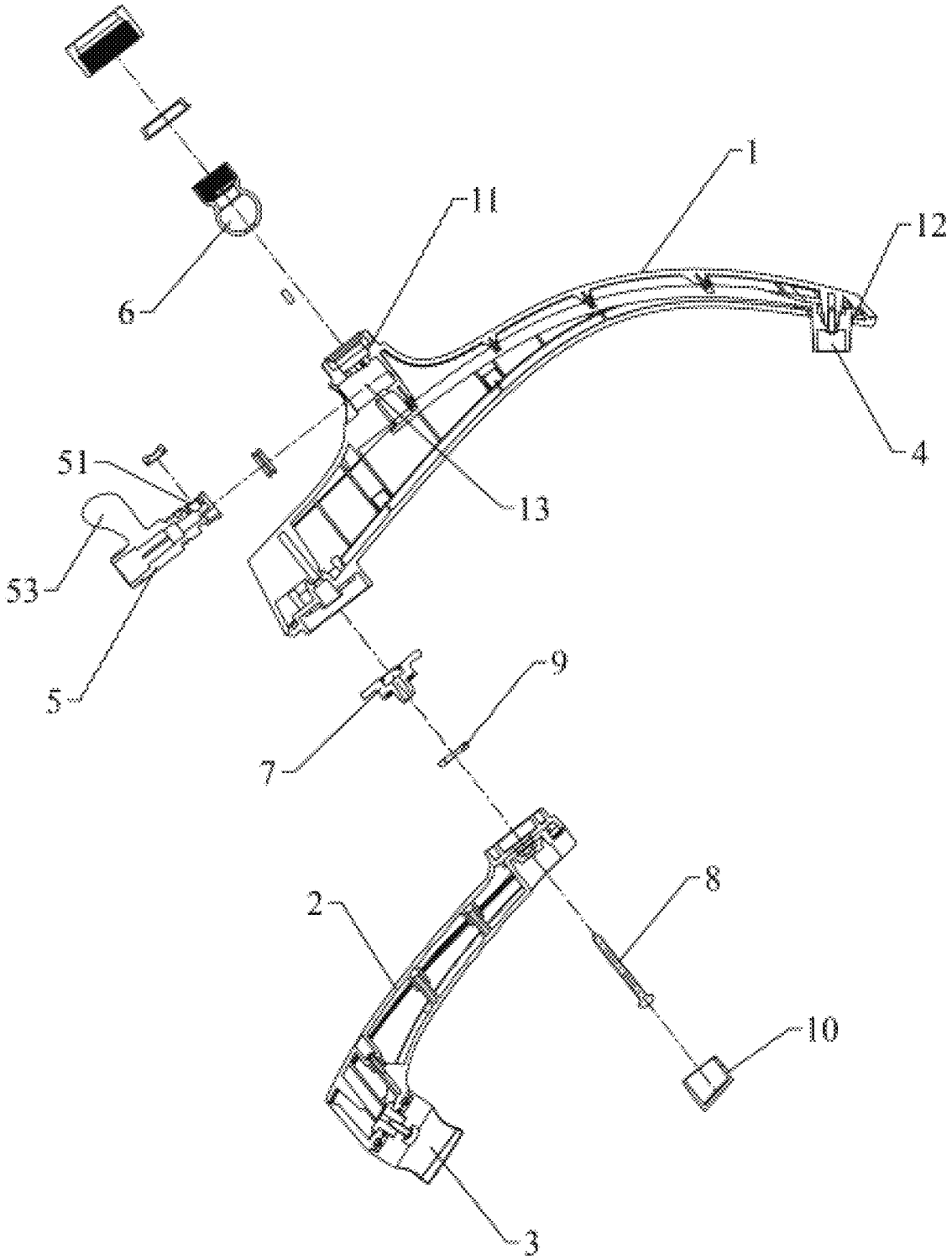
FIG. 4 is a cross-sectional view of an exploded state according to a specific embodiment of the present invention.
Figure 5:
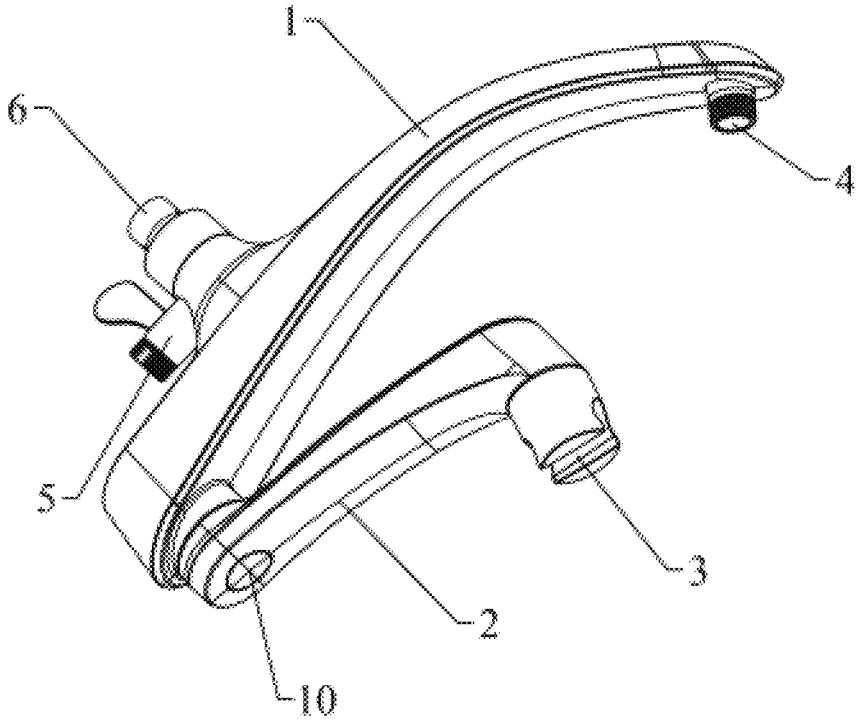
FIG. 5 is a schematic view of a storage state according to a specific embodiment of the present invention.

As shown in FIGS. 1 to 5, the present invention discloses a multi-functional shower-head support arm, including a main support arm 1, an auxiliary support arm 2, and a shower head holder 3.

A back surface of the main support arm 1 is provided with a water inlet 11, an upper end of a front surface thereof is provided with a water outlet 12, and the water outlet 12 communicates with the water inlet 11.

A first end of the auxiliary support arm 2 is rotated to fit with a lower end of the front surface of the main support arm 1.

The shower head holder 3 is rotated to fit with a second end of the auxiliary support arm 2 and is configured to hold and fix a shower head.

In the present invention, through the above solution, a main support arm 1 is combined with an auxiliary support arm 2. The main support arm 1 itself has a water inlet 11 and a water outlet 12, and can be used as a top spray. The auxiliary support arm 2 is mounted with a shower head holder 3 for holding and fixing a shower head, and can be used as a shower head hanger. The combination between the auxiliary support arm 2 and the main support arm 1, and between the shower head holder 3 and the auxiliary support arm 2, is rotatable, allowing the position and direction of the shower head to be adjusted within a 360° range, thus meeting demands for different usage scenarios. Thanks to the direction adjustment of the auxiliary support arm 2 and the shower head holder 3, the main support arm 1 can be mounted on different types of shower rods with water coming out of the top or a side, without limitation. In summary, the product of the present invention has rich use and adjustment functions, can be folded for storage (refer to FIG. 5), and is applied to broad scenarios, meeting various user needs.

The following shows specific embodiments of the present invention.

The present invention further includes a water outlet pipe 4. A water inlet chamber 13 is provided in the water inlet 11 of the main support arm 1, the water outlet pipe 4 is disposed in the main support arm 1, a water inlet end thereof communicates with the water inlet chamber 13, and a water outlet end of the water outlet pipe 4 is fixed at the water outlet 12. The water entering the main support arm 1 is diverted to the water outlet 12 and sprayed out through the water outlet pipe 4.

Further, an adapter 5 is mounted in the water inlet chamber 13, and the adapter 5 is a hollow pipe fitting with an upper end provided with a water inlet hole 51. A circumferential surface of the upper end is provided with a water flowing groove 52. The upper end of the adapter 5 rotatably fits in the water inlet chamber 13, water enters the adapter 5 when the water inlet hole 51 is opposite the water inlet 11, and the water flowing groove 52 is used for communication between the water inlet 11 and the water outlet pipe 4. The adapter 5 may be used to be connected to a shower head hanging on the shower head holder 3 or to another water outlet apparatus, and the adapter 5 itself can be used as a waterway switching valve. In this embodiment, the circumferential surface of the adapter 5 is provided with a toggle 53, making it convenient to operate the adapter 5 for waterway switching.

The water inlet 11 is mounted with a water inlet ball head 6, and the water inlet ball head 6 is used to be threadedly connected to the water outlet end of the shower rod, fixing the main support arm 1, and allowing for adjustment of the main support arm 1 in any direction.

The lower end of the front surface of the main support arm 1 is provided with a rotating seat 7, and the first end of the auxiliary support arm 2 and the rotating seat 7 are arranged co-axially and fixed using a screw 8.

Further, a rubber gasket 9 is provided between contact surfaces of the main support arm 1 and the auxiliary support arm 2 to enhance friction and provide damping.

In addition, the first end of the auxiliary support arm 2 is provided with a perforation 21 for the screw 8 to penetrate, and the perforation 21 is covered by a cover 10, providing aesthetic, dust-proof, and rust-proof effects.

The above embodiments and drawings do not limit the product form and style of the present invention. Any appropriate changes or modifications made by persons of ordinary skill in the technical field shall fall into the patent scope of the present invention.

The invention claimed is:

1. A multi-functional shower-head support arm, comprising:

a main support arm, an auxiliary support arm, and a shower head holder; wherein a back surface of the main support arm is provided with a water inlet along a target axis, an upper end of a front surface of the main support arm is provided with a water outlet, and the water outlet communicates with the water inlet, wherein the front surface is in opposite position from the back surface;

a first end of the auxiliary support arm is rotatably connected to a lower end of the front surface, a direction of the rotation axis of the auxiliary support arm is substantial the same as a direction of the target axis; and the shower head holder is rotated to fit with a second end of the auxiliary support arm and is configured to hold and fix a shower head.

2. The multi-functional shower-head support arm according to claim 1, further comprising:

a water outlet pipe, wherein a water inlet chamber is provided in the water inlet of the main support arm, the water outlet pipe is disposed in the main support arm, a water inlet end thereof communicates with the water inlet chamber, and a water outlet end of the water outlet pipe is fixed at the water outlet.

3. The multi-functional shower-head support arm according to claim 2, wherein an adapter is mounted in the water inlet chamber, the adapter is a hollow pipe fitting with an upper end provided with a water inlet hole, a circumferential surface of the upper end is provided with a water flowing groove, the upper end of the adapter rotatably fits in the water inlet chamber, water enters the adapter when the water inlet hole is opposite the water inlet, and the water flowing groove is used for communication between the water inlet and the water outlet pipe.

4. The multi-functional shower-head support arm according to claim 3, wherein a circumferential surface of the adapter is provided with a toggle.

5. The multi-functional shower-head support arm according to claim 1, wherein the water inlet is mounted with a water inlet ball head.

6. The multi-functional shower-head support arm according to claim 1, wherein the lower end of the front surface of the main support arm is provided with a rotating seat, and the first end of the auxiliary support arm and the rotating seat are arranged co-axially and fixed using a screw.

7. The multi-functional shower-head support arm according to claim 6, wherein a rubber gasket is provided between contact surfaces of the main support arm and the auxiliary support arm.

8. The multi-functional shower-head support arm according to claim 6, wherein the first end of the auxiliary support arm is provided with a perforation for the screw to penetrate, and the perforation is covered by a cover.

* * * * *